United States Patent [19]

Hirai et al.

[11] Patent Number: 4,595,827

[45] Date of Patent: Jun. 17, 1986

[54] COOKING APPARATUS WITH WEIGHING DEVICE

[75] Inventors: Kazumi Hirai, Nabari; Mitsuo Akiyoshi, Nara; Chikao Nakano, Yamatokoriyama; Kenji Watanabe; Satoru Kodama, both of Nara, all of Japan

[73] Assignee: Matsushita Electric Industrial Co., Ltd., Osaka, Japan

[21] Appl. No.: 728,610

[22] Filed: Apr. 29, 1985

[30] Foreign Application Priority Data

May 2, 1984 [JP] Japan ..... 59-88702
Jun. 8, 1984 [JP] Japan ..... 59-118445
Jul. 26, 1984 [JP] Japan ..... 59-155829

[51] Int. Cl.[4] ..... H05B 6/68

[52] U.S. Cl. ..... 219/518; 219/10.55 B; 219/10.55 F; 219/10.55 E; 99/325; 177/84; 177/244

[58] Field of Search ..... 219/10.55 B, 10.55 E, 219/10.55 F, 10.55 R, 518; 177/4, 5, 54, 55, 58, 152, 83–88, 194, 195, 244; 99/325, DIG. 14

[56] References Cited

U.S. PATENT DOCUMENTS 920,004 4/1909 Aue ..... 177/58
1,144,685 6/1915 Bernia ..... 177/54
2,603,442 7/1952 Snyder et al. ..... 177/58 X
4,299,115 11/1981 Athey et al. ..... 219/10.55 R
4,467,881 8/1984 Kitagawa ..... 177/58 X

*Primary Examiner*—Philip H. Leung
*Attorney, Agent, or Firm*—Spencer & Frank

[57] ABSTRACT

A cooking apparatus includes a rotary table which is disposed inside a heating chamber such as to mount a food to be heated, and a motor which rotates the rotary table. The rotary table and the motor are integrally supported in a floating state by a resilient member, thereby allowing the food and the rotary table to vibrate or move vertically. This vertical vibration or movement is measured by employing a detector, and the weight of the food is measured from the output of the detector. The rotary table is provided with a biasing means interlocked with a door for regulating the height of the rotary table or stabilizing the same when the door is opened. In the case where the vibration of the rotary table is particularly detected, the rotary table is forced to vibrate by the action of the biasing means thereby allowing highly accurate measurement of the weight of the food. The output of the heating source, the heating mode and the heating time are controlled in correspondence with the measured weight of the food, and it is therefore possible to improve the cooking apparatus such that it is conveniently used and to realize a finely controlled heating operation.

2 Claims, 12 Drawing Figures

F.I G.6

COOKING APPARATUS WITH WEIGHING DEVICE

BACKGROUND OF THE INVENTION

1. Field of the Invention

The present invention relates to a cooking apparatus with a weighing device which is capable of measuring the weight of an object to be heated and automatically controlling the output of a heating source, the heating mode, the heating time and so forth in accordance with the measured weight.

2. Description of the Prior Art

To carry out cooking by means of conventional cooking apparatus such as a high-frequency heater, it is generally necessary to conduct complicated and troublesome operations such as those described in the following and, therefore, it has not been easy to handle such conventional cooking apparatus. Two examples of prior cooking apparatus will be explained hereinunder.

Referring first to FIG. 1 which shows the structure of one example of prior cooking apparatus, a heating chamber 1 has a door 2 provided on its front side in such a manner that it is possible for the door 2 to be opened and closed as desired. The heating chamber 1 is connected with a waveguide 3 which is provided at the other end thereof with a magnetron 4 serving as a heating source. The radio wave oscillated from the magnetron 4 is applied to the inside of the heating chamber 1 through the waveguide 3. A food 5 is mounted on a rotary plate 6 which is rotated by a motor 7 during heating for the purpose of effecting uniform heating, whereby the food 5 is subjected to high-frequency heating. Such a prior cooking apparatus, however, involves a troublesome operation in which it is necessary for the user to set a heating time in accordance with the amount or weight of each individual food 5 to be heated by means, for example, of a time switch.

Referring next to FIG. 2 which is a fragmentary sectional view of another example of prior cooking apparatus, a food 8 is placed on a rotary plate 9 which is in turn mounted on a rotary table 10. The rotary table 10 is supported by a shaft 11 which is retained by a bearing A 12 and a bearing B 13 in such a manner that the shaft 11 is rotatable and movable in the direction of thrust. The shaft 11 is provided with a gear A 14 which is engaged with a gear B 16 which is provided on a motor 15, whereby the shaft 11 is rotatingly driven by the motor 15 through the gears 14 and 16. The shaft 11 is further supported by a support plate 18 which is in turn supported by a spring 17 such that the load downwardly applied to the shaft 11 is born by the support plate 18. Thus, when the food 8 is placed on the rotary plate 9, the support plate 18 moves to a position where the weight of the food 8 is canceled by virtue of the resiliency of the spring 17 which is compressed to a degree corresponding to the weight of the food 8. The respective positions of the rotary table 10 and the support plate 18 in the state wherein no food 8 is placed on the rotary plate 9 are shown by the solid line in FIG. 2, while their respective positions in the state wherein the load of the food 8 is applied to the rotary table 10 and the support plate 18 are shown by the two dot-chain lines.

In consequence, it is possible to measure the weight of the food 8 by detecting the movement or position of the support plate 18. If the operation of the magnetron is controlled by employing an output obtained as the result of such detection, it is conveniently possible to effect an appropriate heating operation in accordance with the amount or weight of the food 8 without any need to set a heating time for each individual food 8.

Such a prior cooking apparatus, however, suffers the following disadvantages. Namely, the engagement between the gear A 14 provided on the shaft 11 and the gear B 16 unfavorably involves resistance to the vertical movement of the shaft 11. Further, since a frictional resistance occurs between the shaft 11 and the bearings 12 and 13, it is not easy for the load of the food 8 to be accurately transmitted to the support plate 18. For this reason, it is not possible to effect accurate measurement of weight of the food 8, which fact disadvantageously leads to setting of an incorrect heating time and consequently involves incapability of effecting an excellent heating operation.

Further, the rotary plate 9 and the rotary table 10 in a non-loaded state are raised to their respective positions shown by the solid line and, there is therefore a difference in level between the rotary plate 9 and the bottom surface of the heating chamber relative to the upper surface of the door when it is open. For this reason, when the door is opened and the rotary plate 9 is taken out of the heating chamber, it is not easy to pull out the rotary plate 9. Furthermore, since the rotary table 10 is supported by the spring 17, when the rotary plate 9 or the food 8 is mounted thereon, the rotary table 10 is vertically moved and therefore unstable. Thus, this type of prior cooking apparatus is inconvenient for use and may make the user feel uncomfortable when operating the apparatus.

SUMMARY OF THE INVENTION

In view of the above-described disadvantages of the prior art, it is a primary object of the present invention to make it possible to automatically set an optimal heating time, heating power and so forth in relation to a cooking apparatus without any need for the user to effect such setting by measuring the weight of the food to be heated, thereby conveniently facilitating the handling of the cooking apparatus, and to improve the arrangement of the weight measuring means of the cooking apparatus, thereby increasing the degree of accuracy in measuring the weight of a food to be heated.

To this end, the present invention provides a cooking apparatus with a weighing device which includes a heating chamber for housing a food to be heated, a heating source for supplying a heating energy to the inside of the heating chamber, a rotary table (turntable) for rotating the food inside the heating chamber, and a motor for driving the rotary table. The rotary table and the motor are integrated with each other and are retained by a resilient member such as to be vertically oscillatable or movable. The cooking apparatus is further provided with a detector which detects the vertical movement of the rotary table, the motor or the resilient member, the operation of the heating source being controlled by the output of the detector. The resilient member is formed from a plurality of leaf springs which in combination constitute a rovable mechanism. The resilient member is designed to have a small thickness so as to be housed in a small space. The detector is constituted by a magnet and a coil for the purpose of increasing the measuring accuracy and is arranged such as to detect a vertical vibration of the rotary table, the motor or the resilient member. Further, the cooking apparatus may be provided with a push-down mechanism which is interlocked with the door and adapted to push down the rotary table. The push-down mechanism forces the rotary table to vibrate in the vertical direction. Furthermore, the cooking apparatus is provided with a circuit which controls the output of the heating source, the heating time and so forth in correspondence with the detected weight of the object to be heated.

By virtue of the above-described arrangement, the handling of the cooking apparatus is facilitated, and the apparatus is thereby favorable improved such as to be conveniently used. Further, the provision of the device for measuring the weight of the food placed inside the heating chamber advantageously eliminates the need for the weighing operation which is conventionally required before cooking, thereby allowing efficient cooking.

The above and other objects, features and advantages of the present invention will become clear from the following description of the preferred embodiments thereof, taken in conjunction with the accompanying drawings.

DESCRIPTION OF THE PREFERRED EMBODIMENTS

Figure 1:
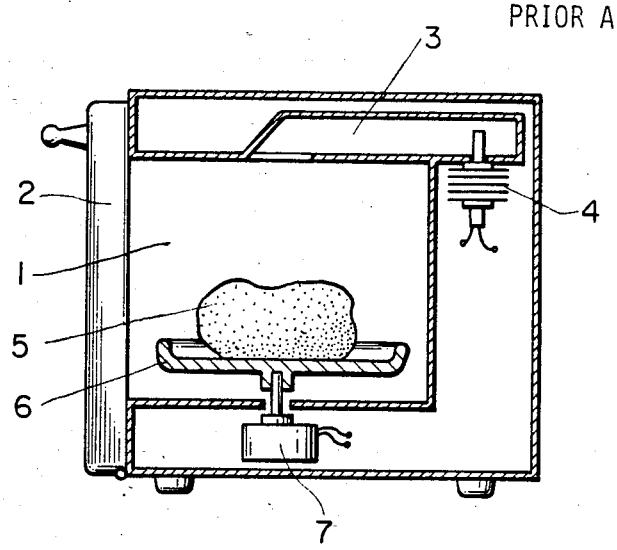
FIG. 1 PRIOR ART
FIG. 1 is a sectional view of one example of prior cooking apparatus.
Figure 2:
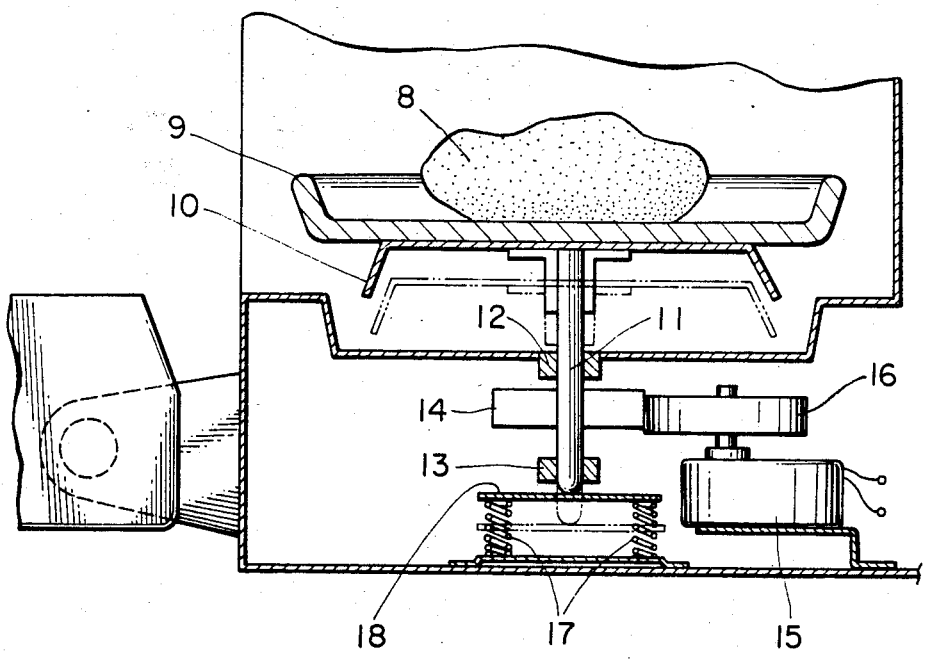
FIG. 2 PRIOR ART
FIG. 2 is a fragmentary sectional view of another example of prior cooking apparatus.
Figure 3:
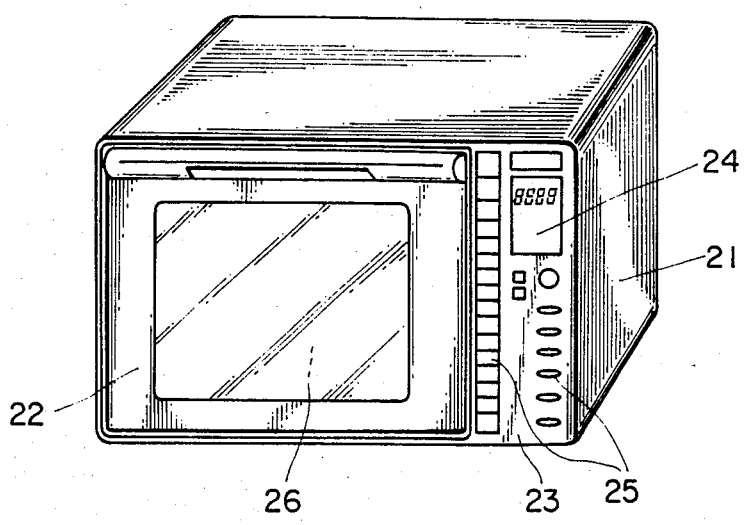
FIG. 3 is a perspective view of the body of a cooking apparatus with a weighing device in accordance with one embodiment of the present invention.

Referring now to FIG. 3, a body 21 of a cooking apparatus has a door 22 disposed on the front side thereof in such a manner that it is possible for the door 22 to be opened and closed as desired. A control panel 23 is provided with a display section 24 which displays the weight of a food to be heated and a heating time. The control panel 23 has various keys 25 properly disposed thereon, the keys 25 being actuated when selecting, for example, a kind of cooking and a heating output as well as setting a heating time and starting a cooking operation. With the door 22 opened, a food is loaded in and unloaded from a heating chamber 26.

Figure 4:
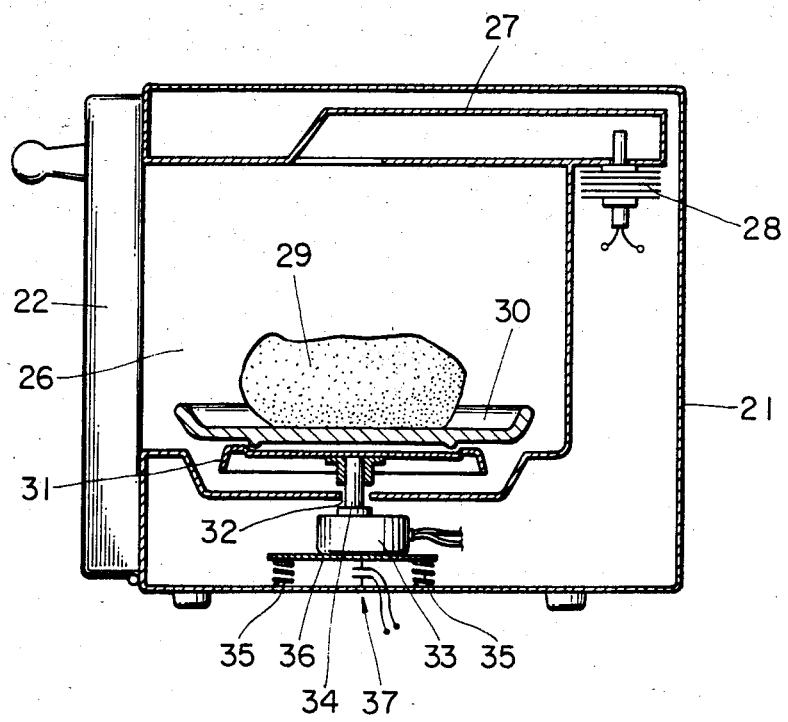
FIG. 4 is a sectional side elevational view in partial cross-section of the cooking apparatus shown in FIG. 3.

Referring next to FIG. 4, the door 22 is provided on the front side of the heating chamber 26. The heating chamber 26 is provided with a waveguide 27 in such a manner that one of the ends of the waveguide 27 is communicated with the inside of the heating chamber 26. A magnetron 28 serving as a heating source is provided at the other end of the waveguide 27. The magnetron 28 applies a radio wave to the inside of the heating chamber 26 through the waveguide 27, whereby a food 29 as an object to be heated is subjected to high-frequency heating. The food 29 is placed on a rotary plate 30 which is in turn mounted on a rotary table 31. The rotary table 31 is directly fitted on a shaft 34 of a motor 33 which is passed through an opening 32 provided in the bottom surface of the heating chamber 26, whereby the rotary table 31 is rotated by the motor 33. The motor 33 thus integrally connected with the rotary table 31 is retained by a support plate 36 which is in turn supported by a resilient member such as a coiled spring 35. The support plate 36 is thus adapted to move vertically in accordance with the correlation between the resiliency of the coiled spring 35 and the load, that is, the weight of the food 29. The vertical movement of the support plate 36 is detected as a signal by a detector 37 which is adapted to detect the movement of the support plate 36 as, for example, a change in capacitance of a capacitor which is constituted by parallel plates, whereby the operation of the magnetron 28 is controlled through a control circuit in accordance with the signal output from the detector 37. The weight of the food 29 directly acts on the resilient member without being affected by any frictional resistance which would occur between the shaft 34 and bearings or between gears in the prior arrangement. For this reason, it is possible to better the correlation of the displacement of the resilient member with the weight of the food 29. Accordingly, it is advantageously possible to effect highly accurate measurement of the weight of the food 29 and consequently to carry out optimal heating for each individual food.

Figure 5:
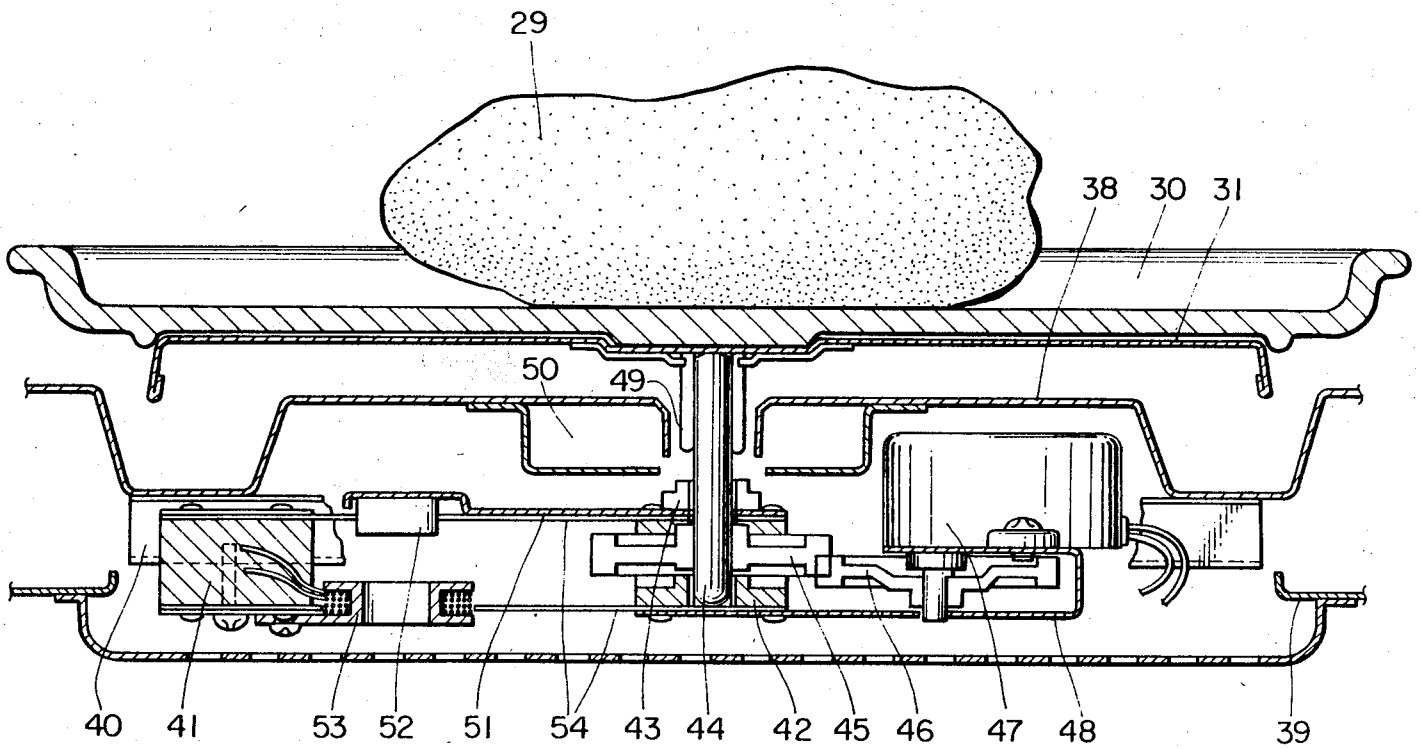
FIG. 5 is a fragmentary sectional view of the weight measuring section of a cooking apparatus in accordance with another embodiment of the present invention.

Referring now to FIG. 5 which shows the weight measuring section of a cooking apparatus in accordance with another embodiment of the present invention, the food 29 is placed on the rotary plate 30 which is in turn mounted on the rotary table 31. A space is provided between the bottom surface 38 of the heating chamber and the bottom 39 of the body of the cooking apparatus, and a vibration mechanism, which will be described hereinunder, is housed within this space.

A mounting frame 40 is secured to the underside of the heating chamber bottom surface 38. A block A 41 is mounted on the mounting frame 40. One of the ends of each of a plurality of leaf springs 54 disposed in parallel is secured to the block A 41, while the other end of each of the leaf springs 54 is secured to a block B 42. The block B 42 also serves as a lower bearing which supports a shaft 44 in cooperation with an upper bearing 43. The shaft 44 has a gear A 45 firmly secured thereto. The gear A 45 is engaged with a gear B 46 which is in turn connected to a motor 47, whereby the shaft 44 is rotated by the motor 47 through the gears 45 and 46. The motor 47 is secured to a motor mounting plate 48 which is integrally provided with the block B 42. The shaft 44 is passed through an opening 49 which is provided in the center of the heating chamber bottom surface 38 and is detachably connected with the rotary table 31. A choke cavity 50 is provided at the opening 49 for the purpose of preventing the leakage of radio waves. The block B 42 is integrally provided with a magnet mounting plate 51. A magnet 52 is secured to the magnet mounting plate 51, and a coil 53 is disposed at a position where it opposes the magnet 52.

Figure 6:
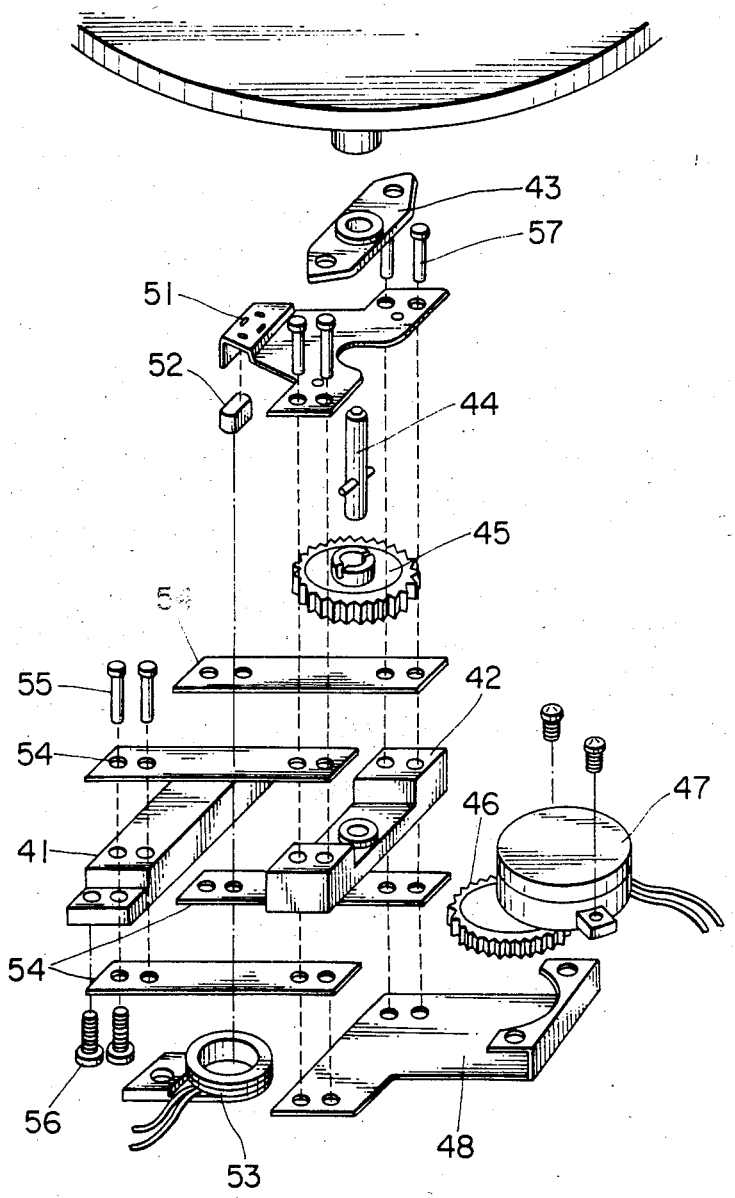
FIG. 6 is an exploded perspective view of the vibration mechanism in the weight measuring section shown in FIG. 5.

Referring next to FIG. 6, the block A 41 and the leaf springs 54 are integrally caulked by employing rivets 55 and secured to the mounting frame 40 by the use of screws 56. The block B 42, the leaf spring 54, the motor mounting plate 48 and the magnet mounting plate 51 are integrally caulked by rivets 57, and the shaft 44 and the gear A 45 are secured to this integral structure through the upper bearing 43.

Figure 7:
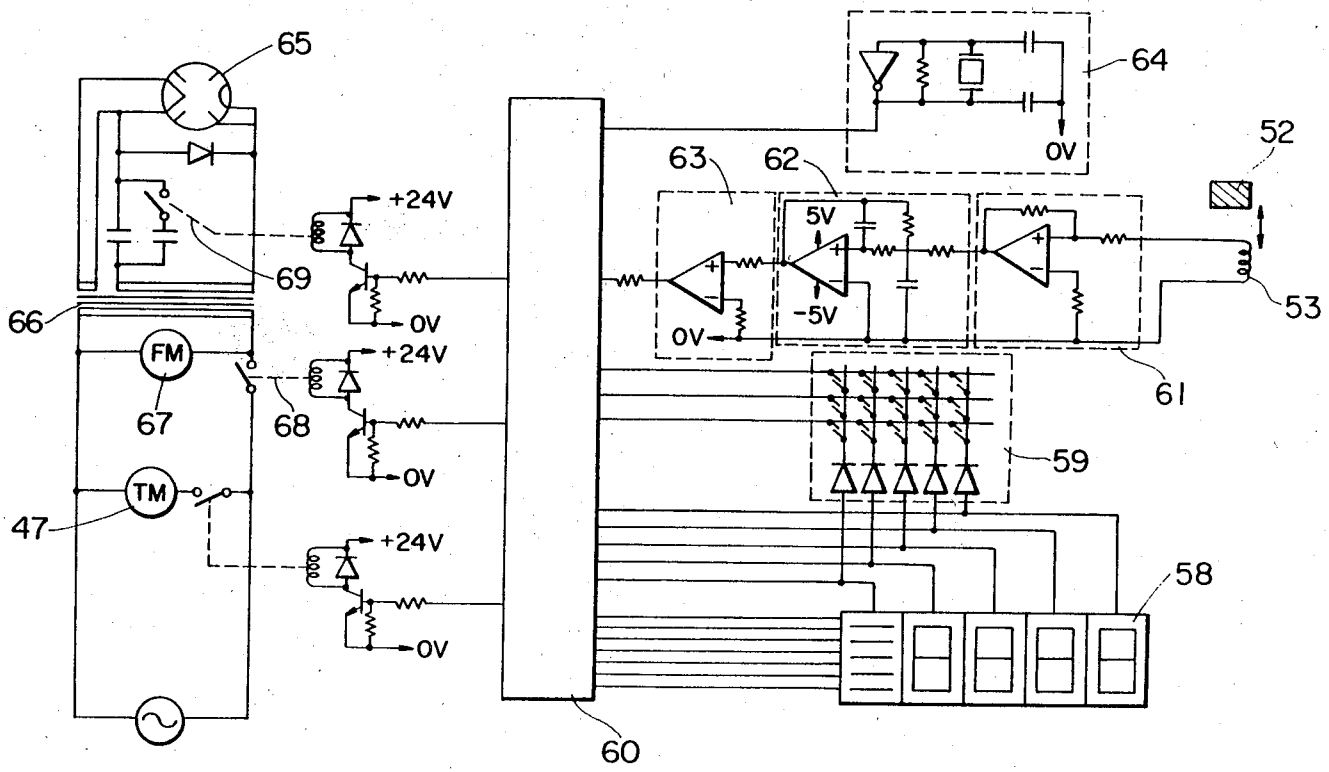
FIG. 7 is a circuit diagram of a control circuit employed in the cooking apparatus shown in FIG. 5.

FIG. 7 is a circuit diagram of a control circuit employed in the cooking apparatus arranged as above, the reference numeral 58 denotes a display section disposed on the control panel provided on the body of the cooking apparatus, while the numeral 59 represents a setting section which is also disposed on the control panel and connected to a microcomputer 60. The electric signal generated in the coil 53 as the result of vibration of the magnet 52 is relatively small and may be affected by radio waves and other disturbance. Therefore, the electric signal is first amplified by an amplifier circuit 61 and then passed through a filter circuit 62 for the purpose of removing any undesirable portion of the signal affected by radio waves or other disturbance. The frequency of the signal generated by the vibration of the magnet 52 is low, i.e., on the order of 1 to 100 Hz. In this case, therefore, a low-pass filter is employed. The output passing through the filter circuit 62 is further passed through a wave shaping circuit 63 where the signal is shaped into a square wave, and this square-wave signal is processed by the microcomputer 60. The reference numeral 64 denotes an oscillator circuit which generates a fundamental frequency employed to measure the vibration frequency. A magnetron 65 which generates a high-frequency wave is supplied with an electric power from a high-voltage transformer 66. The reference numeral 67 represents a fan motor for cooling the magnetron 65; 68 a power supply making relay for supplying the electric power to the magnetron 65; and 69 an output control relay for controlling the output of the magnetron 65.

The following is a description of the operation of the above-described arrangement.

The weight of the food 29 is applied to the block B 42 through the rotary table 31. Since the block B 42 is supported by the leaf springs 54, at the moment, for example, the food 29 is placed on the rotary plate 30, the food 29 and the rotary table 31 vibrate at a vibration frequency corresponding to the correlation between the weight of the food 29 and the resiliency of the leaf springs 54. In other words, the larger the weight of the food 29, the smaller the vibration frequency; the smaller the weight of the food 29, the larger the vibration frequency. The magnet 52 vibrates in response to the vibration of the rotary table 31, thus causing a signal to be generated in the coil 53. This signal is input to the microcomputer 60 through the amplifier circuit 61, the filter circuit 62 and the wave shaping circuit 63.

The microcomputer 60 effects storage, judgement, calculation, inputting and outputting of data on the basis of that input signal and information fed from the setting section 59. By the signals output from the microcomputer 60, information is displayed on the display section 58, and the power supply making relay 68 and the output controlling relay 69 are actuated so as to control the output of the magnetron 65, the heating mode, the heating time and so forth.

The weight of each of the rotary plate 30, the rotary table 31 and the vibration mechanism has also previously been stored in the microcomputer 60, whereby it is possible to detect the weight of the food 29 alone by carrying out proper calculation.

Thus, it is possible according to this embodiment to automatically set an appropriate heating time and an optimal heating power by measuring the weight of the food 29. It is therefore possible to eliminate the need for the troublesome setting operation which is conventionally required for each individual food to be heated, and to realize a vibration mechanism which is advantageously housed in even a narrow space at the bottom of the heating chamber. Further, since the weight of the food 29 is detected by the measurement of vibration, it is possible for a detection signal to be directly input to the microcomputer 60 in the form of a digital signal with a simple circuit, so that it is favorably possible to measure the weight of the food 29 with an advantageously high degree of accuracy.

Furthermore, it is possible by virtue of the above-described arrangement to obtain the following advantageous effects.

(1) It is possible to detect the weight of the food 29 on the rotary table 31 as a vibration frequency by means of the vibration mechanism. It is therefore only necessary to employ an extremely simple circuit as compared with the detection of weight by the measurement of, for example, the displacement of a member of a weight detecting device. Moreover, since it is possible for a detection signal to be directly input to the microcomputer 60 in the form of a digital signal, there is no risk of intrusion of any error in the course of detection, which fact makes it possible to effect highly accurate measurement.

(2) If the operation of the magnetron 65 serving as a heating source is controlled through a control unit such as the microcomputer 60 by measuring the weight of the food 29, it is then possible to automatically carry out an optimal heating operation without the need for the user to set a heating mode and a heating time for each individual food.

Further, if this arrangement is combined with a sensor which detects a change occurring during heating of the food 29, such as a temperature sensor, a humidity sensor, a gas sensor or an infrared ray sensor, it is then possible to realize a nearly full-automatic cooking operation.

Furthermore, the cooking apparatus is increased in safety by adopting a circuit configuration whereby it is possible to prevent "empty cooking operation" in which heating is accidentally carried out without any food 29 placed in the heating chamber.

(3) By virtue of the arrangement of the vibration mechanism in which a plurality of leaf springs 54 are disposed in parallel, it is possible for the leaf springs 54 to serve as a resilient member for generating a vibration and also serve as a rovable mechanism which holds the rotary table 31 horizontal at all times. Therefore, a simple construction with a small number of constituent elements suffices. In addition, the frictional resistance occurring when the vibration mechanism causes a vibration is favorably small, which fact permits a favorably reliable operation. Moreover, since it is possible for the vibration mechanism to be arranged such as to be flat or small in thickness, it is possible to correspondingly reduce the housing space therefor at the bottom of the heating chamber. Accordingly, the cooking apparatus is advantageously reduced in its size and made convenient for use.

(4) The rotary table 31 serves as a turntable for rotating the food 29 and also serves as a pan for measuring the weight of the food 29, and the construction of the inside of the heating chamber is favorably simplified. It is therefore possible to easily carry out cleaning of the heating chamber by removing the rotary table 31. In addition, it conveniently becomes, as a matter of course, unnecessary to move the food 29 when measuring its weight and when heating the same.

(5) Since the vibration mechanism is disposed outside the heating chamber and at the bottom thereof, the amount of heat transferred to the vibration mechanism is favorably small. For this reason, there is hardly a risk of the leaf springs 54, for example, being affected by the heat such as to lead to an increase in number of measuring errors, and the life of the vibration mechanism is extended correspondingly.

Furthermore, as to materials for the constituent elements of the vibration mechanism, it suffices to employ those which have relatively low heat-resisting properties, which fact advantageously involves reduction in the production cost of the vibration mechanism.

(6) It is possible for the block constituting the vibration mechanism to be integrally formed with the heating chamber by securing the blocks to the underside of the bottom surface of the heating chamber. It is therefore possible for the vibration mechanism to sufficiently support even a heavy food 29. It is possible to further intensify the strength of this supporting structure by properly drawing the bottom surface of the heating chamber or appropriately designing the configuration of the mounting frame.

Further, since the vibration mechanism is integrally formed with the heating chamber, it is advantageously easy to obtain a required accuracy in positioning the shaft, which fact permits reliable rotation of the shaft.

Furthermore, the vibration mechanism is not directly connected to the bottom of the cooking apparatus body. For this reason, it is possible to increase the measuring accuracy also from this aspect.

Figure 8:
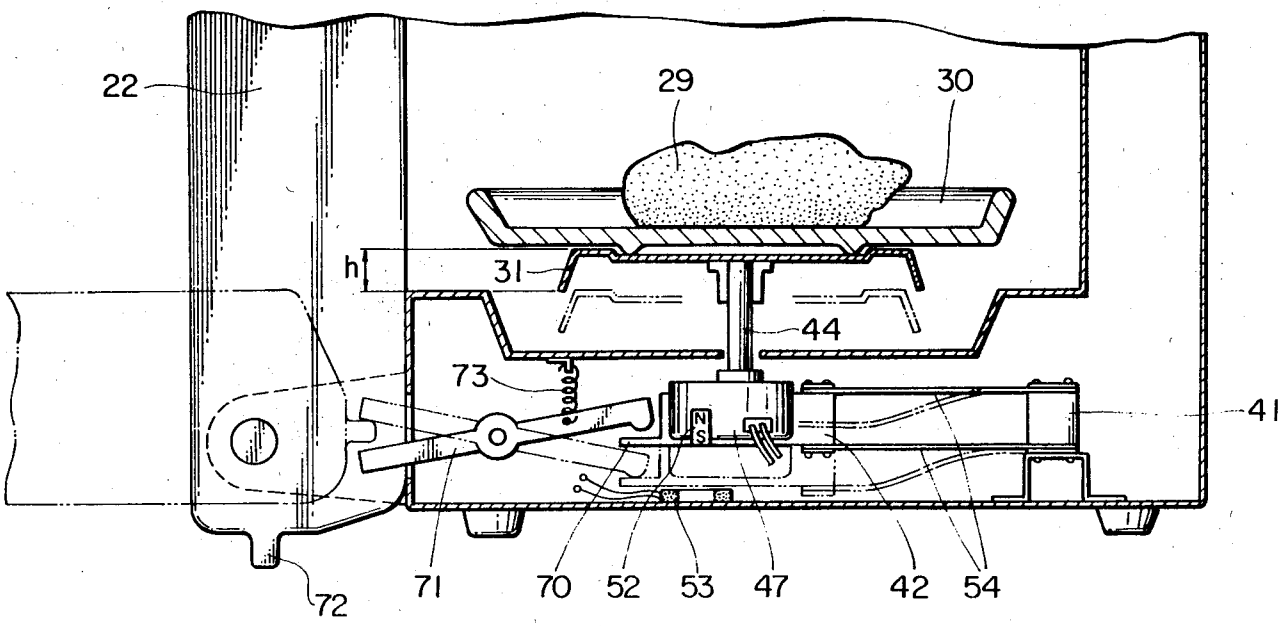
FIG. 8 is a sectional view of a weight measuring section of a cooking apparatus in accordance with still another embodiment of the present invention, the weight measuring section being provided with a push-down mechanism.

FIG. 8 is a sectional view of still another embodiment of the cooking apparatus according to the present invention in which the weight measuring section is provided with a push-down mechanism which serves as a biasing means. In the Figure, the elements with the same functions as those shown in FIG. 5 are denoted by the same reference numerals.

In the embodiment shown in FIG. 8, the motor 47 directly connected to the shaft 44 such as to rotate the latter is secured to the block A 42 which is resiliently supported by a plurality of leaf springs 54. The block A 42 is provided with an abutting portion 70. A lever 71 is provided at a position where one (referred to as a "first end", hereinafter) of this ends opposes the abutting portion 70. The other end (referred to as a "second end", hereinafter) of the lever 71 opposes a projection 22 provided on the door 22. The reference numeral 73 denotes a tension spring which acts such that the lever 71 is pulled up to the position shown by the solid line.

When the door 22 is opened, the projection 72 abuts against the second end of the lever 71, causing the latter to pivot. Consequently, the first end of the lever 71 abuts against the abutting portion 70 to push-down the block A 42. The constituent elements of the cooking apparatus in relation to the push-down mechanism in the state wherein the door 22 is closed are shown by the solid line, while those in the state wherein the door 22 is opened are shown by the two-dot chain line.

In a free state wherein the door 22 is closed, there is a difference h in level between the upper surface of the rotary table 31 and the bottom surface of the heating chamber. However, when the door 22 is opened, the upper surface of the rotary table 31 and the bottom surface of the heating chamber are made flush with each other, thereby allowing the rotary plate 30 to be smoothly pulled out onto the upper surface of the open door 22.

Since the push-down mechanism is suddenly canceled when the door 22 is closed, a vertical vibration of the food 29 or the rotary table 31 is reliably caused at that time and, it is therefore possible to take out a favorably large signal from the detector. Accordingly, it is advantageously possible to accurately detect the weight of the food 29 by measuring the frequency of the vertical vibration of the food 29 or the rotary table 31. It is also possible to easily synchronize the timing of generation of a signal which represents the fact that the door 22 has been closed and the timing at which a signal output from the detector is read off. Thus, it is possible to effect accurate measurement of the weight of the food 29.

Figure 9:
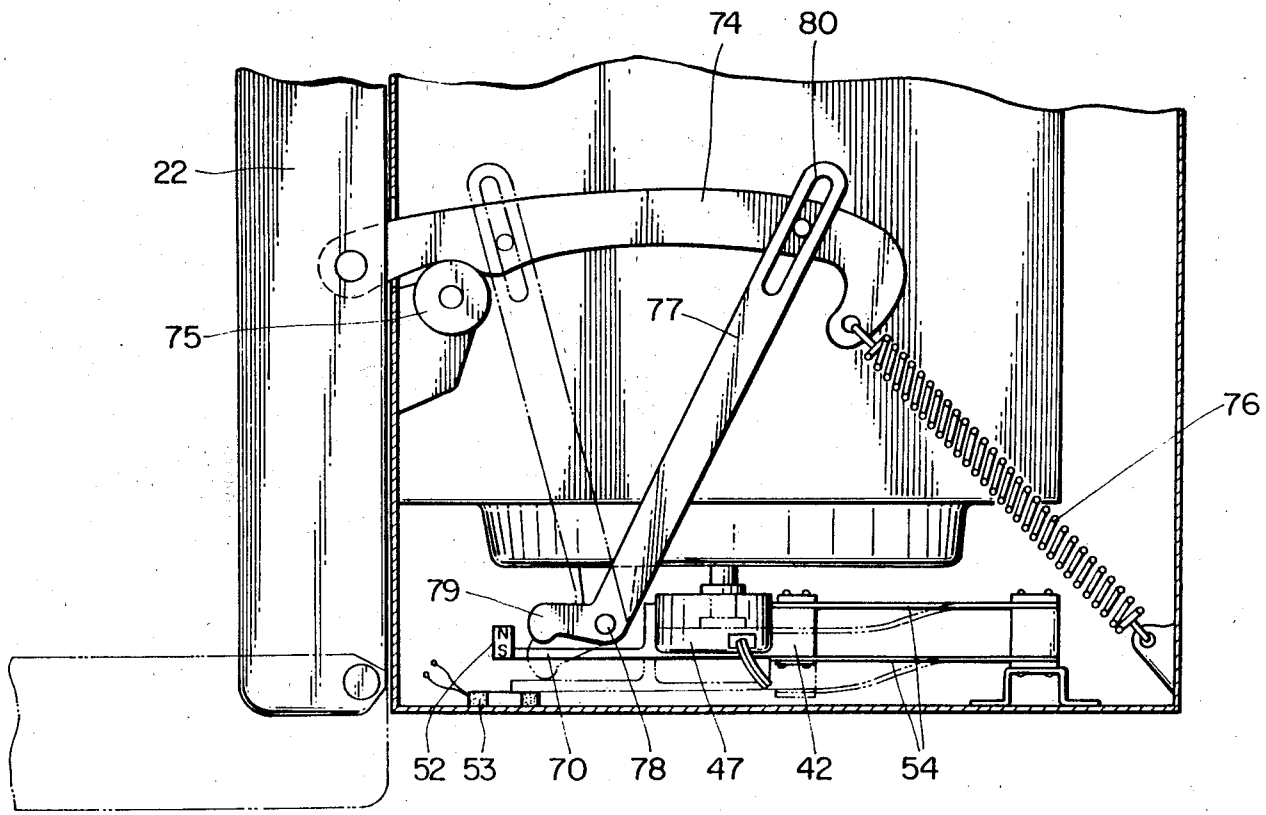
FIG. 9 is a sectional view of a weight measuring section of the cooking apparatus according to the present invention, the weight measuring section being provided with a push-down mechanism which is interlocked with a door arm.

FIG. 9 is a sectional view of a weight measuring section provided with a push-down mechanism as a biasing means which is interlocked with a door arm 74.

As shown in FIG. 9, the door 22 has the door arm 74 pivotally provided thereon. The door arm 74 is adapted to slide on a roller 75 provided on the cooking apparatus body, thereby allowing the door 22 to be smoothly opened and closed. The door arm 74 is provided with a door spring 76 which biases the door arm 76 in the direction in which the door arm 74 pulls the door 22. Thus, the weight of the door 22 is canceled when it is opened and closed, whereby the force required to open and close the door 22 is favorably reduced and the door 22 is reliably closed. A lever B 77 is pivotally supported by a pivot 78 above the abutting portion 70. The lever B 77 has its lower end 79 opposing the abutting portion 70 and its upper end 80 pivotally engaged with the arm 74.

By virtue of the above-described arrangement, when the door 22 is opened, the lever B 77 is moved to the position shown by the two-dot chain line. Consequently, the lower end 79 of the lever B 77 pushes down the abutting portion 70 and, therefore, the motor 47 is also pushed down, thus causing the rotary table to be pushed down. Since the lever B 77 is adapted to move in engagement with the door arm 74, a lever action obtained from the linking between the lever B 77 and the door arm 74 advantageously makes it possible for the rotary table to be reliably pushed down with such a small force that the user feels no resistance when actuating the door 22.

Figure 10:
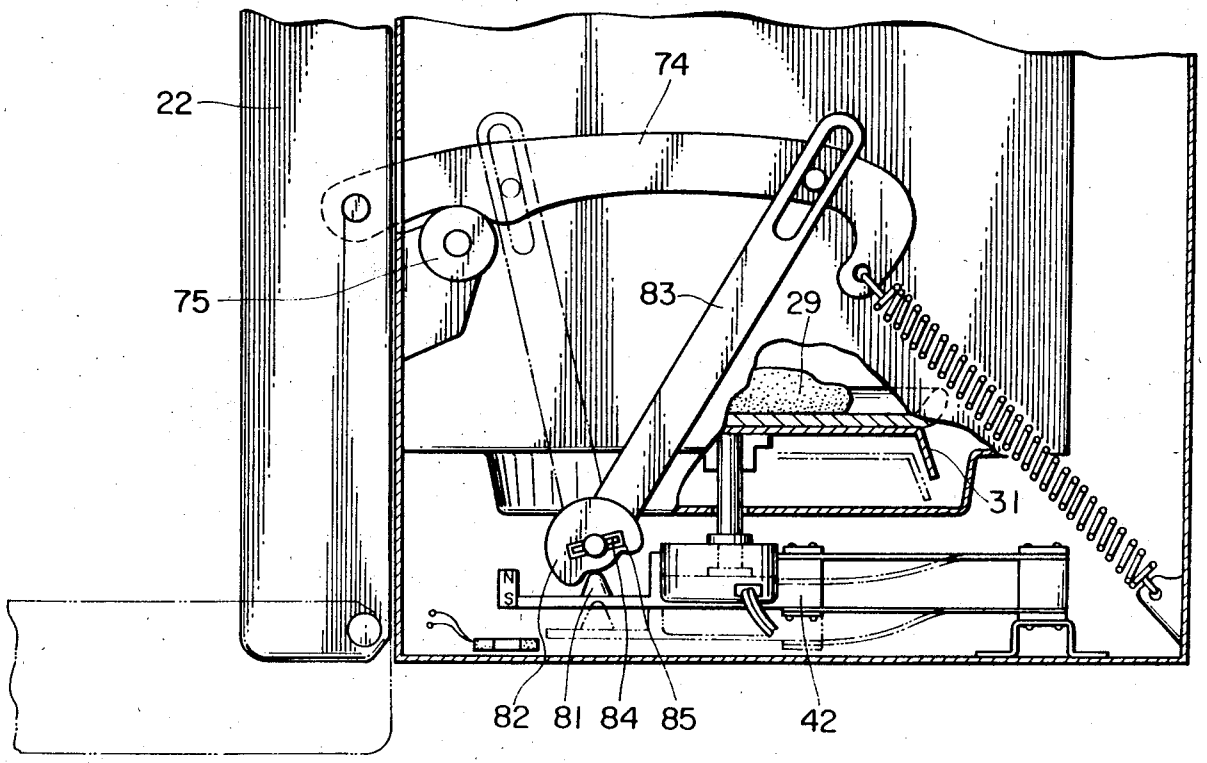
FIG. 10 is a sectional view of a weight measuring section of the cooking apparatus according to the invention, the weight measuring section being provided with a push-down mechanism which has a quick-acting function.

FIG. 10 is a sectional view of a weight measuring section provided with a push-down mechanism as a biasing means which has a quick-acting function.

As shown in FIG. 10, the block A 42 is provided with an abutting portion 81 which has a projection. A cam 82 is provided at a position where it opposes the abutting portion 81. The cam 82 is connected through a groove 84 to a pin 84 which is rotated by a lever 83. The groove 85 has a width slightly larger than the diameter of the pin 84 such that a clearance or play is provided therebetween. The lever 83 is pivotally connected at its upper end to the door arm 74 provided on the door 22. When the door 22 is opened, the lever 83 is moved to the position shown by the two-dot chain line while rotating the pin 84. Consequently, the cam 82 is rotated and causes the abutting portion 81 to be pushed down. As a result, the block A 42 is moved to the position shown by the two-dot chain line. On the other hand, when the door 22 is closed, the lever 83 is moved by the action of the door arm 74, thus causing the cam 82 to rotate in such a manner that the abutting portion 81 is returned to its previous position. In this case, since some play is provided between the pin 84 and the groove 85, the cam 82 slides down along the slope of the groove 85 at the time when the recessed portion of the cam 82 comes to face the abutting portion 81. At this time, the cam 82 is therefore rotated at a speed increased by its sliding action as the result of the play and, consequently, the abutting portion 81 is suddenly allowed to slide upwardly. Thus, when the abutting portion 81 is returned, the block A 42 is effectively returned with a quick action.

By virtue of the above-described action of the quick-acting return mechanism, a vertical vibration is reliably generated, and it is possible to take out an advantageously large signal from the detector when the weight of the food 29 is measured by detecting the frequency of the vertical vibration of the food 29 or the rotary table 31. Further, since a vibration is reliably generated, it is possible to discriminate the vibration to be detected from any external vibration, that is, noise vibration, which may be applied to the detector when the cooking apparatus body is installed at a place where it is undesirably subjected to vibrations (i.e., the S/N ratio is favorably increased). For this reason, it becomes possible to effect accurate and reliable detection of the vibration frequency at any place.

Figure 11:
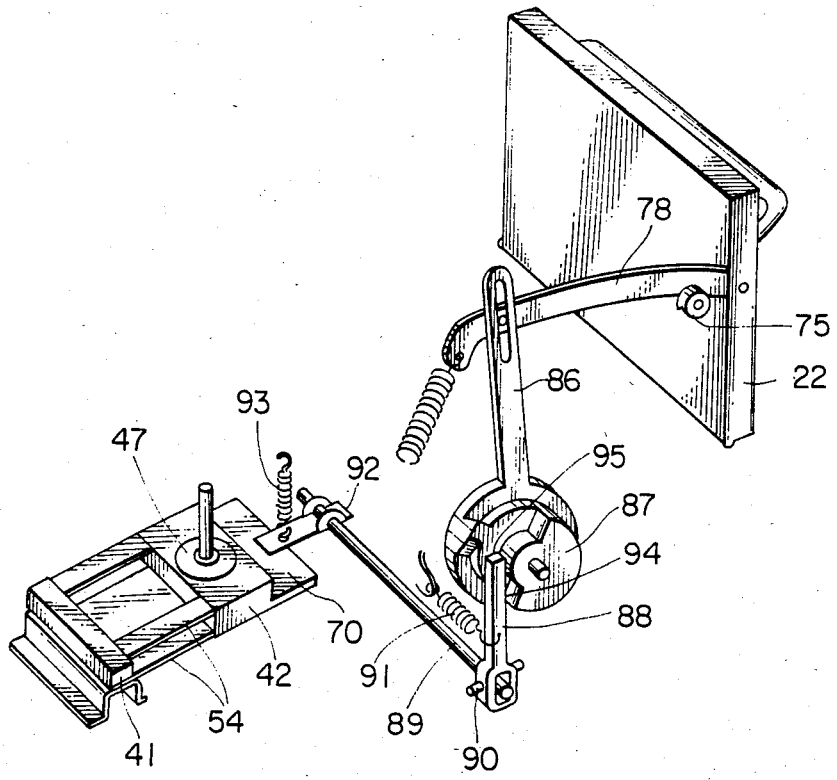
FIG. 11 is a perspective view of an essential constituent portion of a further example of the arrangement of the push-down mechanism and the weight measuring section of the cooking apparatus according to the present invention.

FIG. 11 is a perspective view of an essential constituent portion of a further example of the arrangement of the push-down mechanism as a biasing means and the weight measuring section.

As shown in FIG. 11, the door 22 is provided in such a manner that it is possible for the door 22 to be opened and closed as desired in relation to the heating chamber. The door 22 has the door arm 74 adapted to slide on the roller 75 provided on the cooking apparatus body, thereby allowing the door 22 to be smoothly opened and closed. The motor 47 is secured to the block A 42 which is connected to the block B 41 through a plurality of leaf springs 54. The block B 41 is secured to the bottom of the cooking apparatus body. A lever 86 is pivotally connected to the door arm 74, and a cam 87 is integrally provided on the lever 86 such as to be rotated by the lever 86. A lever B 88 is disposed so as to abut against the cam 87. The lever B 88 is pivotally supported by a pin 90 which is secured to one of the ends of a shaft 89. A lever B spring 91 is constituted by a coiled spring and adapted to pull the lever B 88 in the direction orthogonal to the axis of rotation of the cam 87. A lever C 92 is fixedly provided at the other end of the shaft 89. The lever C 92 has its distal end opposing the abutting portion 70 which is integrally formed on the block A 42. The lever C 92 is biased by a lever C 93 in the direction in which the distal end of the lever C 93 comes away from the abutting portion 70.

Figure 12:
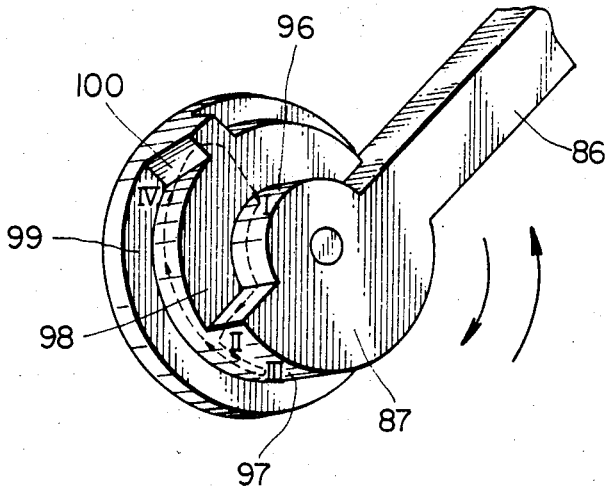
FIG. 12 is a fragmentary enlarged perspective view of the push-down mechanism of the cooking apparatus according to the invention, which shows the cam and a part of a lever which constitute a part of the push-down mechanism shown in FIG. 11.

Referring now to FIG. 12, the cam 87 is provided with a smaller-diameter portion 96 and a larger-diameter portion 97. A side surface 94 of the lever B 88 is caused to abut against the other peripheral surface of the cam 87, whereby the lever B 88 is pivoted in the radial direction of the cam 87 in response to the rotation of the cam 87. The smaller-diameter portion 96 and the larger-diameter portion 97 are respectively provided with a thrust surface A 98 and a thrust surface B 99 in such a manner that these thrust surfaces 98 and 99 have a difference in level therebetween. The cam 87 is further provided with a slanting surface 100 which connects the thrust surfaces 98 and 99 to each other. The inner surface 95 of the lever B 88 slides while successively abutting against the thrust surfaces 98, 99 and the slanting surface 100, whereby the lever B 88 is pivoted in the direction of thrust.

The following is a description of the operation of the arrangement shown in FIGS. 11 and 12.

The sliding path of the side surface 94 of the lever B 88 on the cam 87 is shown by the broken-line arrows. FIG. 11 shows the arrangement in the state wherein the door 22 is closed. In this state, the side surface 94 of the lever B 88 is placed such as to abut against the smaller-diameter portion 96 by the biasing action of the lever C 93. At this time, the side surface 94 of the lever B 88 is at the point I in the sliding path on the cam 87. In this state, the lever C 92 is separated from the abutting portion 70. When the door 22 is opened to its half-open position, the large-diameter portion 97 of the cam 87 pushes the lever B 88 outwardly in the radial direction of the cam 87. At this time, the side surface 94 of the lever B 88 is at the position II in the sliding path on the cam 87. In consequence, the lever B 88 is pivoted counterclockwise as viewed in FIG. 11, and this turning force is transmitted through the shaft 89 to the lever C 92. Thereupon, the lever C 92 is pivoted in such a manner that its distal end pushes down the abutting portion 70, and the rotary table (not shown) is thereby pushed down until it becomes flush with the bottom surface of the heating chamber. Then, the inner surface 95 of the lever B 88 is shifted at the point II from the thrust surface A 98 to the thrust surface B 99 by means of the force of the lever B spring 91.

When the door 22 is totally opened, the cam 87 further rotates, and the side surface 94 of the lever B 88 reaches the point III in the sliding path on the cam 87. As the door 22 is closed, the sliding path on the cam 87 U-turns. However, since the side surface 94 of the lever B 88 slides only on the larger-diameter portion 97 of the cam 87, the lever B 88 does not move at all. Accordingly, the abutting portion 70 is maintained in the pushed-down state.

When the door 22 is closed to a nearly totally closed position, the slide contact point of the side surface 94 of the lever B 88 reaches the point IV in the path on the cam 87. Thereupon, the inner surface 95 of the lever B 88 slides on the slanting surface 100 and moves up from the thrust surface B 99 to the thrust surface A 98 against the pulling force of the lever B spring 91. At the same time, the side surface 94 of the lever B 88 is separated from the larger-diameter portion 97 and moved to the point I on the smaller-diameter portion 96 by the force of the lever C spring 93. At this time, the lever B 88 moves in a moment with a quick action. In response to this quick action of the lever B 88, the lever C 92 also quickly cancels its operation of pressing the abutting portion 70.

By virtue of the above-described arrangement, the lever B 88 three-dimensionally moves on the cam 87 over a wide area and serves to push down as well as quickly return the abutting portion 70. Since the lever B 88 also provides a leverage action, there is no risk of a concentrated force acting on any mechanism portion, such as the cam 87 or the lever B 88. Therefore, the slide movement of the lever B 88 on the cam 87 is favorably smooth, so that it is possible to obtain a reliable operation of the push-down mechanism through a very natural operation of opening and closing the door 22.

As has been described above, according to the present invention, the rotary table, together with the motor, is supported in a floating state by means of the resilient member, and the degree or vibration frequency of vertical movement of the food, the rotary table or other associated members is measured by the detector. Accordingly, it is possible to automatically measure the weight of a food simply by placing the food on the rotary table inside the heating chamber. Further, the heating time, the heating output and the heating mode are automatically controlled in correspondence with the measured weight of the food. Thus, the invention provides a very convenient cooking apparatus.

Moreover, if the arrangement is such that the rotary table, the motor and so forth are vibrated by the operation of opening and closing the door which is inevitably conducted when a food is placed in the heating chamber, it is then possible to reliably cause the rotary table and other associated members to vibrate, which permits an advantageously reliable detection of weight of the food.

Although the invention has been described through specific terms, it is to be noted here that the described embodiments are not exclusive and various changes and modifications may be imparted thereto without departing from the scope of the invention which is limited solely by the appended claims.

What is claimed is:

1. A cooking apparatus with weighing device comprising:

a heating chamber for housing and heating an object to be heated;

a heating source for heating the object;

a rotary table disposed inside said heating chamber for mounting the object;

a driving device for rotating said rotary table;

a resilient member supporting both said rotary table and said driving device, said resilient member, said driving device and said rotary table being movable as a unit in a vertical direction in dependence of the weight of an object mounted on said rotary table; and detector means for detecting a vertical movement of one of said rotary table, said driving device and said resilient member, said detector means including means for determining the weight of an object on said rotary table from a detection of the vertical movement and for producing an output signal corresponding to said weight, the operation of said heating source being controlled by said output signal.

2. A cooking apparatus according to claim 1, wherein said detector means for detecting the vertical movement of one of said rotary table, said driving device and said resilient member comprises a magnet and a coil.

* * * * *